United States Patent [19]

Movshovitz et al.

[11] Patent Number: 4,635,395

[45] Date of Patent: Jan. 13, 1987

[54] LOUVER ASSEMBLY PARTICULARLY USEFUL FOR AIR-CONDITIONING UNITS OR OTHER LIKE APPLIANCES

[75] Inventors: Avner Movshovitz, Tel-Aviv; Joel Shwarzman, Givatayim, both of Israel

[73] Assignee: Amcor Ltd., Tel Aviv, Israel

[21] Appl. No.: 761,594

[22] Filed: Aug. 1, 1985

[30] Foreign Application Priority Data

Feb. 4, 1985 [IL] Israel ..... 74233

[51] Int. Cl.[4] ..... E05F 17/00; G05G 9/00; F24F 13/00

[52] U.S. Cl. ..... 49/78; 74/471 R; 74/527; 74/553; 98/110

[58] Field of Search ..... 49/77, 78, 87, 88; 98/110, 113, 121.2; 74/471 R, 495, 527, 533, 553, 540

[56] References Cited

U.S. PATENT DOCUMENTS

| | | | |
|---|---|---|---|
| 2,948,211 | 8/1961 | Melgaard | 98/110 |
| 2,996,970 | 8/1961 | Goettl | 98/110 |
| 3,301,164 | 1/1967 | Eberhart | 98/110 |

*Primary Examiner*—Kenneth J. Dorner
*Assistant Examiner*—Gerald A. Anderson
*Attorney, Agent, or Firm*—Benjamin J. Barish

[57] ABSTRACT

A louver assembly particularly useful for air-conditioning units and other like appliances comprises a frame defining an opening; a first group of slats extending along one coordinate axis mounted to the frame within the opening and pivotable about that axis; a second group of slats extending along a second coordinate axis mounted on the first group of slats within the opening and pivotable about that axis; and a manipulatable knob coupled to both groups of slats such that moving the knob in a direction parallel to the second coordinate axis pivots the first group of slats about the first coordinate axis, and rotating the knob about the second coordinate axis pivots the second group of slats about the second coordinate axis.

19 Claims, 4 Drawing Figures

LOUVER ASSEMBLY PARTICULARLY USEFUL FOR AIR-CONDITIONING UNITS OR OTHER LIKE APPLIANCES

BACKGROUND OF THE INVENTION

The present invention relates to louver assemblies, and also to an adjusting device particularly useful in such assemblies. The invention is especially useful in louver assemblies for directing the air from an air-conditioning unit, fan, heater or other like appliance, and is therefore described below with respect to this application.

Louver assemblies for air-conditioning units or other like appliances commonly include a group of vertically-extending slats and a group of horizontally-extending slats, one or both of which groups are adjustable in order to direct the air as desired. One common arrangement is to make only one group of slats adjustable, to permit adjustment of the air direction along one coordinate axis; if adjustment along the other coordinate axis is desired, the louver assembly is removed and rotated 90°. Another known arrangement is to provide the slats in the form of two separate groups, each pivotably mounted to the frame and adjustable by a separate manipulatable member, such as a lever or knob.

SUMMARY OF THE INVENTION

An object of the present invention is to provide a louver assembly of novel construction in that it permits the two groups of slats to be adjusted by operating a single manipulatable member. Another object of the present invention is to provide an adjusting device particularly useful in the novel louver assembly.

According to a broad aspect of the present invention, there is provided a louver assembly comprising a frame defining an opening; a first group of slats extending along one coordinate axis mounted to said frame within said opening and pivotable about said one coordinate axis; a second group of slats extending along a second coordinate axis mounted on the first group of slats within the opening and pivotable about the second coordinate axis; and a manipulatable member coupled to both the groups of slats such that moving the manipulatable member in one direction pivots the first group of slats about the first coordinate axis, and moving the manipulatable member in another direction pivots the second group of slats about the second coordinate axis.

In the preferred embodiment of the invention described below, the manipulatable member is a knob and is coupled to both the groups of slats such that moving the knob in a direction parallel to the second coordinate axis (e.g. horizontally) pivots the first group of slats about the first coordinate axis (e.g. vertically), and rotating the knob about the second coordinate axis pivots the second group of slats about the second coordinate axis.

According to another aspect of the invention, there is provided an adjusting device comprising a knob movable in the longitudinal and rotary directions, and including a first plurality of recesses formed on one section of the knob extending parallel to the longitudinal direction, and a second plurality of recesses formed on another section of the knob and extending perpendicular to the longitudinal direction; a first projection receivable in the first plurality of recesses for releasably retaining the knob in position when moved in the longitudinal direction; and a projection receivable in the second plurality of recesses for releasably retaining the knob in position when moved in the rotary direction.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
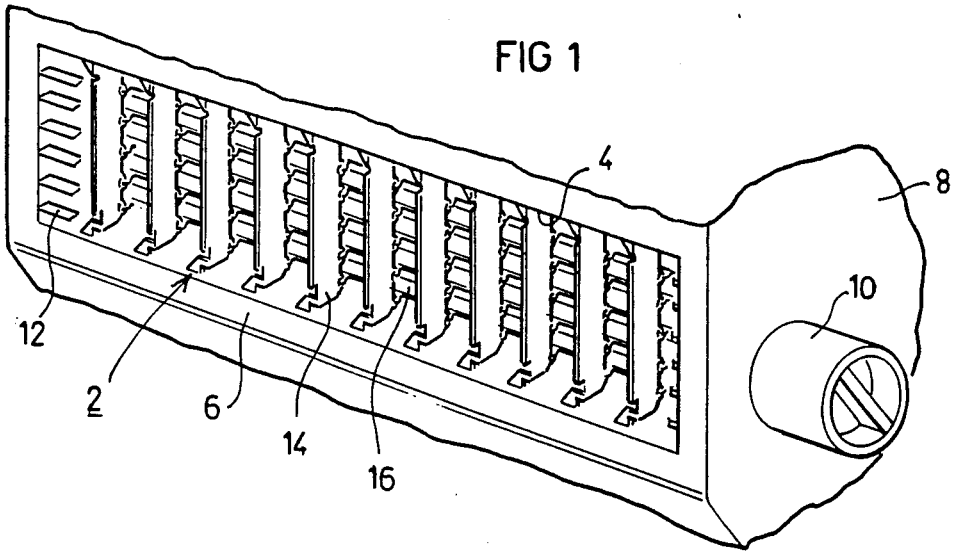
FIG. 1 illustrates a louver assembly constructed in accordance with the invention as incorporated in an electrical appliance, such as an air-conditioning unit, fan, or heater.

As shown in FIG. 1, the louver assembly illustrated therein, and generally designated 2, is mounted within a rectangular opening 4 formed in the frame 6 of an electrical appliance, such as an air-conditioning unit 8, to direct the cooled air exiting therefrom. The electrical appliance 8 is provided with a knob 10 passing through an end wall of the appliance and manipulatable by the user in order to direct the air as desired. As will be described more particularly below, in this case knob 10 is moved longitudinally, (i.e., parallel to its longitudinal axis) in order to pivot the vertical slats in the louver assembly 2 about the vertical axis, and is rotated about its horizontal axis in order to pivot the horizontal slats about the horizontal axis.

The appliance 8 illustrated in FIG. 1 also includes a protective grill 12 applied to the outer side of the louver assembly 2. The slats of the protective grill are fixed and not adjustable. Only a small end portion of protective grill 12 is illustrated in FIG. 1 in order to permit a better showing of the louver assembly 2 behind the grill.

Figure 2:
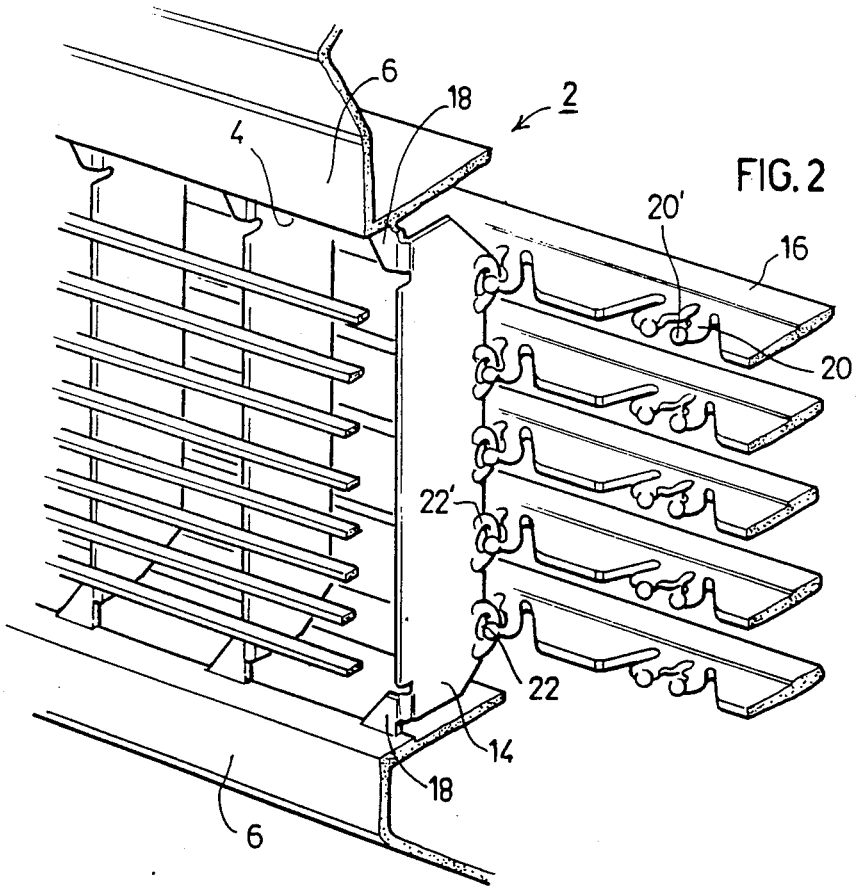
FIG. 2 is a fragmentary three-dimensional view illustrating the construction and mounting of the slats in the louver assembly of FIG. 1.

As seen in FIGS. 1 and 2, louver assembly 2 includes two groups of slats each extending along one coordinate axis and pivotable about its respective axis. Thus, the illustrated assembly includes a group of vertically-extending slats 14 each pivotable about the vertical axis, and a group of horizontally-extending slats 16 each pivotable about the horizontal axis. The vertically-extending slats 14 are located forwardly of the horizontally-extending slats 16, i.e. adjacent to the protective grill 12.

FIG. 2 more particularly illustrates the construction of the vertically-extending slats 14 and their pivotable mountings to the frame 6. The vertically-extending slats 14 are formed integrally with frame 6, as by injection molding plastic, such that each slat 14 extends across the complete height of opening 4 within frame 6 and is connected at each of its opposite ends by a web 18 integrally formed with frame 6. Webs 18 thus serve as plastic hinges which permit each of the slats 14 to be pivoted about its vertical axis.

FIG. 2 also illustrates the structure of the horizontally-extending slats 16 and their pivotable mountings permitting them to be pivoted about the horizontal axis. Thus, each slat 16 is formed with a plurality of pairs of spring fingers 20 spaced along its length, there being one pair of fingers in each slat 16 for each of the vertically extending slats 14 and receivable in openings 22 formed in slats 14. Spring fingers 20 in slats 16 are thickened at their tips, as shown at 20'; and similarly, the openings 22 in slats 14 are circumscribed by an annular thickened rib, as shown at 22'. This arrangement permits slats 16 to be applied by a snap-action to slats 14 by merely snapping spring fingers 20 of slats 16 into openings 22 of slats 14. Such an arrangement not only effects a pivotable mounting of slats 16 to slats 14, but also enables slats 16 to be quickly attached and detached from slats 14 for cleaning or repair purposes.

Figure 3:
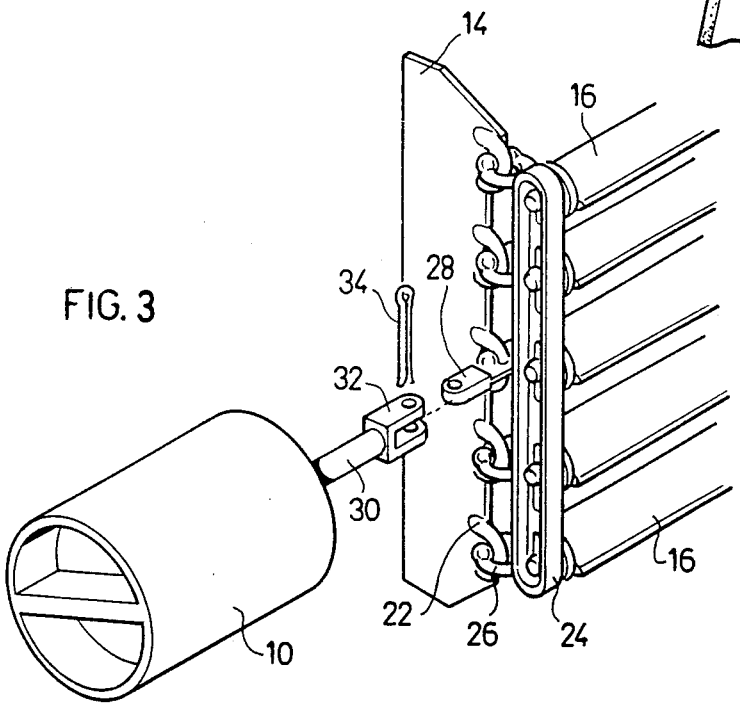
FIG. 3 is a three-dimensional view illustrating the coupling of the slats to the manipulatable knob to permit both vertical and horizontal adjustment of the slats.

As shown in FIG. 3, the opposite ends of the horizontally-extending slats 16 are pivotably mounted to a pair of end links 24 (only one end being shown in FIG. 3), which links extend in the vertical direction, i.e. parallel to slats 14. Each of these end links 24 is also formed with a plurality of pairs of spring fingers 26, corresponding to spring fingers 20 in slats 16, which spring fingers are received within the openings 22 in the two end vertically-extending slats 14. It will thus be seen that all the horizontally-extending slats 16 are coupled by the end links 24 to pivot together with respect to the vertically-extending slats 14.

As also shown in FIG. 3, one of the horizontally-extending slats 16, in this case the center slat, is formed with an extension 28 for coupling the two groups of slats 14 and 16 to knob 10. Thus, knob 10 is formed with a stem 30 terminating in a bifurcated end 32 adapted to receive extension 28 and secured thereto by a pin 34 received within openings in extension 28 and the bifurcated end 32 of the knob stem 30. This arrangement permits knob 10 to be moved in the horizontal direction (i.e. parallel to slats 16), to pivot the vertically-extending slats 14 about the vertical axis, and may also be rotated in order to pivot the horizontally-extending slats 16 about the horizontal axis.

Figure 4:
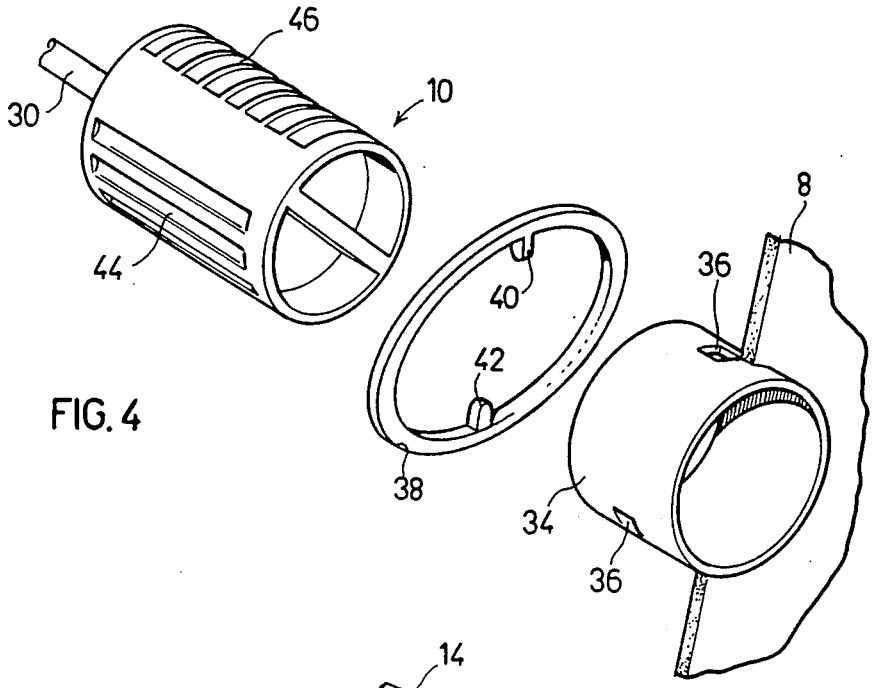
FIG. 4 is a three-dimensional exploded view illustrating the retainer arrangement for releasably retaining the knob in any adjusted position.

FIG. 4 illustrates an arrangement for retaining knob 10 in either of its moved positions. As shown in FIG. 4, the side wall of appliance 8 includes a bushing 34 formed with a pair of square openings 36 on its opposite sides. A plastic spring 38 of elliptical shape is adapted to be applied in a snap-on manner over bushing 34. Spring 38 is integrally formed with a pair of projections 40, 42 on its inner face, at the opposite ends of its minor axis, so as to be aligned with openings 36. The minor axis of elliptical spring 38 is less than the diameter of bushing 34 thereby permitting the spring to be applied in a snap-on manner over bushing 34 with projections 40, 42 received within openings 36.

Knob 10 is formed with a plurality of longitudinally-extending recesses 44 on one side of its outer face, and with a plurality of circumferentially-extending recesses 46 on the opposite side of its outer face. Recesses 46 are cooperable with projection 40 to releasably retain knob 10 in position when the knob is moved longitudinally, i.e. parallel to its horizontal axis; and recesses 44 are cooperable with projection 42 to releasably retain the knob in position when rotated about its longitudinal axis.

It will be seen that knob 10 may be used for pivoting both the vertically-extending slats 14 and the horizontally-extending slats 16 to direct the air flowing out of appliance 8 as desired.

Thus, if knob 10 is moved in the longitudinal direction (i.e. parallel to its horizontal axis), its coupling (elements 30, 32, 28, FIG. 3) to the horizontally-extending slats 16 will shift them, and thereby the vertically-extending slats 14, in the horizontal direction, the pivotable movement of the vertically-extending slats 14 being permitted by their plastic hinge connections 18 to frame 6. Knob 10 will be retained in its longitudinally-moved position by projection 40 of plastic spring 38 received within one of the recesses 46 in the knob.

Now, when it is desired to pivot the horizontally-extending slats 16 about their horizontal axes, this can be done by rotating the same knob 10, which is coupled via the same coupling elements 30, 32, 28, to the center horizontally-extending slat 16. The latter slat is coupled by the end links 24 to all the remaining horizontally-extending slats 16, so that all of the latter slats will thereby pivot, about their spring fingers 20, with respect to the vertically-extending slats 14. Knob 10 is releasably retained in its rotated position by projection 42 of spring 38 received within one of the recesses 40 of the knob.

While the invention has been described with respect to one preferred embodiment, it will be appreciated that many other variations, modifications and applications of the invention may be made.

What is claimed is:

1. A louver assembly comprising:

a frame defining an opening;

a first group of slats extending along one coordinate axis mounted to said frame within said opening and pivotable about said one coordinate axis;

a second group of slats extending along a second coordinate axis mounted on said first group of slats within said opening and pivotable about said second coordinate axis;

and a manipulatable knob coupled to both said groups of slats such that moving said knob in a direction parallel to said second coordinate axis pivots said first group of slats about said first coordinate axis, and rotating said knob about said second coordinate axis pivots said second group of slats about said second coordinate axis.

2. The assembly according to claim 1, wherein each slat in said first group is pivotably mounted to said frame by a plastic hinge formed integrally with said frame at the opposite ends of said slats.

3. The assembly according to claim 1, wherein said second group of slats are pivotably mounted at their opposite ends to a pair of end links extending parallel to said one coordinate axis.

4. The assembly according to claim 1, wherein said second group of slats are pivotably mounted to said first group of slats by a plurality of spring fingers carried along one edge of each slat in one group and pivotably attached to the slats of the other group.

5. The assembly according to claim 4, wherein said spring fingers are integrally formed along along one edge of each slat in said second group and are releasably received within openings formed in each slat of said first group.

6. The assembly according to claim 4, wherein said end links at the opposite ends of said second group of slats are provided with a plurality of spring fingers pivotably attached to the slats of said first group.

7. The assembly according to claim 4, wherein said spring fingers are formed with enlarged tips and are adapted to be received within openings circumscribed by thickened rims formed in the slats of said other group.

8. The assembly according to claim 1, wherein said knob includes first retainer means for releasably retaining the knob in position when moved parallel to said second coordinate axis, and second retainer means for releasably retaining said knob in position when rotated about said second coordinate axis.

9. The assembly according to claim 8, wherein said first retainer means comprises a first plurality of recesses formed in one section of said knob extending parallel to said second coordinate axis and cooperable with a first projection on said frame, and said second retainer means comprises a second plurality of recesses formed on another section of said knob extending parallel to said second coordinate axis and cooperable with a second projection on said frame.

10. The assembly according to claim 9, wherein said frame includes a bushing receiving said knob, said first and second projections of the two retainer means being carried by said spring and passing through openings formed in said bushing to engage said first and second plurality of recesses formed in said knob.

11. The assembly according to claim 10, wherein said spring is a plastic of elliptical shape received in a snap-on manner over said bushing, said plastic spring being integrally formed with said projections on its inner face at the opposite sides of its minor axis.

12. An adjusting device including a knob movable both in a longitudinal direction and a rotary direction, and including a first plurality of recesses formed on one section of the knob extending parallel to said longitudinal direction, and a second plurality of recesses formed on another section of said knob and extending perpendicular to said longitudinal direction;

a first projection receivable in said first plurality of recesses for releasably retaining said knob in position when moved in the longitudinal direction, and a second projection receivable in said second plurality of recesses for releasably retaining said knob in position when moved in the rotary direction.

13. The adjusting device according to claim 12, further including a bushing receiving said knob, said first and second projections being carried by a spring and passing through opening formed in said bushing to engage said first and second plurality of recesses formed in said knob.

14. The adjusting device according to claim 13, wherein said spring is a plastic spring of elliptical shape received in a snap-on manner over said bushing, said plastic spring being integrally formed with said projections on its inner face at the opposite sides of its minor axis.

15. A louver assembly comprising:

a frame defining an opening;

a first group of slats extending along one coordinate axis mounted to said frame within said opening and pivotable about said one coordinate axis;

a second group of slats extending along a second coordinate axis mounted on said first group of slats within said opening and pivotable about said second coordinate axis;

and a knob coupled to both said groups of slats such that moving said knob in a direction parallel to said second coordinate axis pivots said first group of slats about said first coordinate axis, and rotating said knob about said second coordinate axis pivots said second group of slats about said second coordinate axis.

16. The assembly according to claim 15, wherein each slat in said first group is pivotably mounted to said frame by a plastic hinge formed integrally with said frame at the opposite ends of said slats.

17. The assembly according to claim 15, wherein said second group of slats are pivotably mounted to said first group of slats by a plurality of spring fingers carried along one edge of each slat in one group and pivotably attached to the slats of the other group.

18. The assembly according to claim 15, wherein said knob includes first retainer means for releasably retaining the knob in position when moved parallel to said second coordinate axis, and second retainer means for releasably retaining said knob in position when rotated about said second coordinate axis.

19. The assembly according to claim 18, wherein said first retainer means comprises a first plurality of recesses formed in one section of said knob extending parallel to said second coordinate axis and cooperable with a first projection on said frame, and said second retainer means comprises a second plurality of recesses formed on another section of said knob extending parallel to said second coordinate axis and cooperable with a second projection on said frame.

* * * * *